United States Patent [19]

Ozeki

[11] Patent Number: 4,772,244

[45] Date of Patent: Sep. 20, 1988

[54] APPARATUS FOR ADJUSTING COIN PASSING GAP IN COIN HANDLING MACHINE

[75] Inventor: Masamichi Ozeki, Ashikaga, Japan

[73] Assignee: Laurel Bank Machines Co., Ltd., Tokyo, Japan

[21] Appl. No.: 15,067

[22] Filed: Feb. 17, 1987

[30] Foreign Application Priority Data

Feb. 27, 1986 [JP] Japan ..... 61-28182

[51] Int. Cl.[4] ..... G07D 1/00

[52] U.S. Cl. ..... 453/57; 194/335

[58] Field of Search ..... 453/6, 7, 10, 11, 31, 453/56, 57; 194/335

[56] References Cited

U.S. PATENT DOCUMENTS 3,991,778 11/1976 Ushio et al. ..... 453/56
4,123,892 11/1978 Asami ..... 453/31
4,126,146 11/1978 Ozaki ..... 453/56

FOREIGN PATENT DOCUMENTS 0104823 4/1984 European Pat. Off. .
52-26295 2/1977 Japan .
53-11293 1/1978 Japan .
53-56094 5/1978 Japan .
56-95774 7/1981 Japan .
58-171318 10/1983 Japan .
59-12688 4/1984 Japan .
59-121491 7/1984 Japan .

*Primary Examiner*—Joseph J. Rolla
*Assistant Examiner*—Lisa C. Waag
*Attorney, Agent, or Firm*—Fleit, Jacobson, Cohn & Price

[57] ABSTRACT

An apparatus for adjusting a coin passing gap depending on the type of coins to be handled comprises a coin passing unit. The coin passing unit includes a sub-sorting ring and a feed belt, and is mounted about a pivot shaft to be movable between its open and its closed position. The apparatus further comprises lock and guide pins slidably mounted on a machine body. The lock pin is integrally formed on the base of the coin passing unit. At least one of the pins is engaged by a spring. The coin passing unit is supported on the top end of the lock pin. The lock pin is provided at its bottom with a receiving plate which is engaged by a roller on a lever for pivoting of the receiving plate depending on a coin thickness setting cam.

3 Claims, 2 Drawing Sheets

APPARATUS FOR ADJUSTING COIN PASSING GAP IN COIN HANDLING MACHINE

BACKGROUND OF THE INVENTION

The present invention relates to an apparatus for adjusting a gap having a height corresponding to the thickness of coins to be handled at a coin passing area, for example, a sub-sorting ring or a feed belt in a coin handling machine which is adapted to handle coins for subsequent sorting, counting, packing and other operations.

In the conventional coin handling machines, the spacing between coin guiding rails for the external diameter of coins to be handled and the coin passing gap corresponding to the thickness of the coins has been adjusted by adjusting dials. There also is well-known means for vertically moving a guide shaft to adjust the height of the sub-sorting ring by the use of a gap adjusting cam connected with a coin type setting dial through a chain. Moreover, Japanese Utility Model Publication No. 59-12688 discloses a further proposal to effect such operations.

In the first mentioned proposal, various adjustments must be carried out separately. As a result, the operation of the machine becomes cumbersome. Also, the operator may have failed to make adjustments. The second mentioned proposal is disadvantageous in that the machine becomes complicated in construction and in that it is difficult to perform a fine adjustment. The coin handling machine according to the third proposal is complicated in construction since the frame is vertically and translationally moved to perform an adjustment under the action of a linkage. Such a linkage is not suitable for the fine adjustment of the coin passing gap. Furthermore, the linkage requires an increased force to operate the frame.

SUMMARY OF THE INVENTION

An object of the present invention is to provide a unit including all elements required to adjust the gap depending on the type of coins to be handled, such as the subsorting ring, the feed belt and others, said unit being assembled in a cover.

Another object of the present invention is to provide a coin handling machine of a construction which can be simplified and operated by a reduced operating force without any linkage and associated parts due to the fact that the unit is vertically and translationally movable adjacent to a pivot shaft about which the unit is mounted to be pivotable from an opened position to a closed position or vice versa.

BRIEF DESCRIPTION OF THE DRAWINGS

The above and other objects of the invention will be seen by reference to the following description taken in connection with the accompanying drawings, in which.

DESCRIPTION OF THE PREFERRED EMBODIMENT

Figure 1:
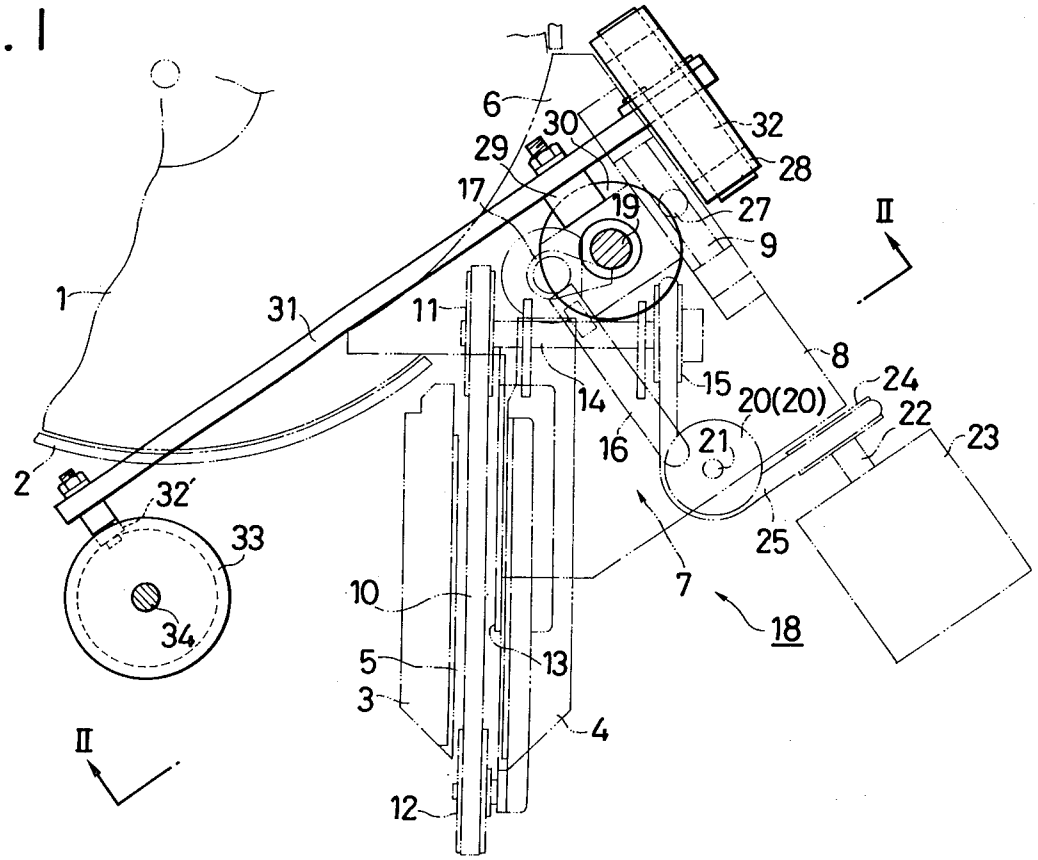
FIG. 1 is a plan view of the primary parts of a coin handling machine constructed in accordance with the present invention, the chain line showing a unit portion on the top face of the primary portion of the present invention shown by solid line.

An embodiment of the present invention will now be described in detail with reference to the drawings.

Reference numeral 1 denotes a rotary disc on which coins are placed. When the rotary disc is rotated to create a centrifugal force, the centrifugal force acts on the coins to move them along the inner periphery of a main sorting ring 2.

The main sorting ring 2 has a notch which, together with guide rails 3 and 4, defines a coin passageway 5 including various well-known components such as coin sorting holes, counter, stop and others.

The main sorting ring 2 is formed at its notch with a sub-sorting ring 6. A unit 8 including gap forming members is formed integrally on a cover concealing a transmission 7. The unit 8 is mounted about a pivot shaft 9 to be pivotable from its opened position to its closed position or vice versa.

The unit 8 includes drive pulleys 11 and 12 between which a feed belt 10 is spanned, a coin holding plate 13, a driven shaft 14 and a driven pulley 15. The unit 8 also includes an actuating lever 16 and a lock pawl 17 which is adapted to engage and disengage a lock pin 19, the top end of the lock pin 19 supporting the unit 8. The unit 8 further includes double type idle pulley means consisting of two idle pulleys 20 which are rotatably mounted on a drive shaft 21. A motor 23 is disposed on the machine body 18 such that an output shaft 22 of the motor 23 is aligned coaxially with the pivot shaft 9 in the unit 8. A transmission belt 25 is spanned in tension between a drive pulley 24 on the output shaft 22 and the driven pulley 15 through the idle pulleys 20.

Figure 2:
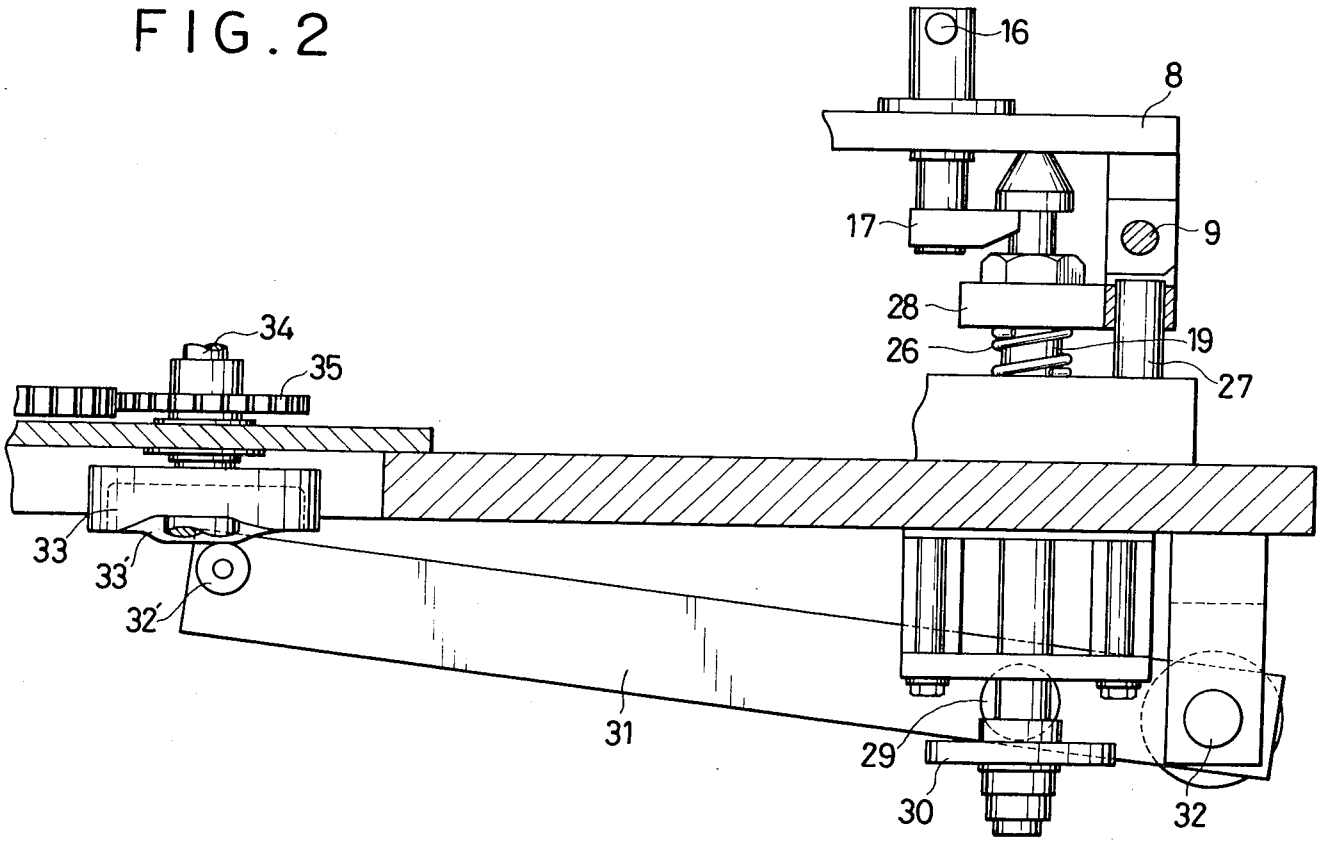
FIG. 2 is a cross-sectional view taken along line II—II in FIG. 1.

The coin handling machine of the present invention further comprises a spring 26 for biasing the lock pin 19 in the upward direction as viewed in FIG. 2 and a supporting member 28 adapted to be guided by the lock pin 19 and a guide pin 27. The supporting member 28 carries said pivot shaft 9 about which the unit 8 including the transmission 7 is pivotally mounted. The pins 19 and 27 are rigidly mounted on the supporting member, but slidable relative to the machine body. The top end of the lock pin 19 supports the unit 8 with the bottom end thereof having a receiving plate 30. A lever 31 is pivotally mounted about a fulcrum 32 and has a roller 29 provided on the side of the lever 31. The roller 29 engages the receiving plate 30 on the lock pin 19 to hold the receiving plate 30 against the action of the spring 26.

The other end of the lever 31 is provided with a cam head 32' which engages a coin thickness setting cam 33 having cam ridges. The cam head 32' co-operates with the ridges on the cam 33 to set the height of the roller 29 and thus the height of the unit 8. The cam 33 is operatively connected with a coin type setting dial (not shown) and a gear 35 through a shaft 34.

In operation, the rotary disc 1 is rotated with coins placed thereon being moved below the sub-sorting ring 6 under the action of a centrifugal force created by the rotation of the disc 1. At the sub-sorting ring 6, false coins having thicknesses larger than a desired thickness are eliminated while only coins having a thickness equal to the desired value are passed through the coin passageway 5 under the action of the feed belt 10. If any fault such as jamming is produced at the sub-sorting ring 6 and/or the coin passageway 5, the actuating lever 16 is manually rotated to disengage the lock pawl 17 from the lock pin 19. When the actuating lever 16 is then lifted, the unit 8 is moved to its opened position about the pivot shaft 9 so that the jammed coins can easily be removed. At this time, the idle pulleys 20 are rotated about the pivot shaft 9 and thus the drive shaft 22. Therefore, the idle pulleys 20 will be moved along a circle about the drive pulley 24. As a result, the transmission belt 25 will not be influenced by the motion of the idle pulleys 20.

When the coin type setting idle is moved to a position corresponding to the type of coins to be handled, the gear 35 is then rotated. At the same time, the coin thickness setting cam 33 is rotated with its cam face 33' causing the cam head 32' and thus the end of the lever 31 to move in the vertical direction. Thus, the height of the roller 29 is set so that the height of the receiving plate 30 is such that the plate always engages with the roller under the biasing force. Simultaneously, the supporting member 28 is vertically and translationally moved under the guidance of the pins 19 and 27 to similarly move the unit 8 for fine adjustment.

The present invention provides a coin handling machine which can simultaneously adjust gaps in the sub-sorting ring and feed belt by providing a unit translated by means of a simple structure consisting of the lock and guide pins. Such a coin handling machine also is of a simple and light-weight construction capable of performing fine adjustments.

What we claim is:

1. An apparatus for adjusting a coin passing gap depending on the type of coins to be handled, said apparatus comprising:

a machine frame disposed horizontally, a lock pin extending vertically and being slidably mounted relative to said machine frame and biased in an upward direction, a guide pin slidably mounted on said machine frame and extending parallel to said lock pin and being movable simultaneously with the movement of said lock pin, a coin passing unit pivotably mounted on a pivot pin fixed on an upper end of said guide pin to be movable between an open position and a closed position, a rotary disc extending horizontally and being rotatably mounted on said machine frame, a sub-sorting ring included in said coin passing unit for partially overlapping said rotary disc in spaced relationship to form a coin path between said sub-sorting ring and said rotary disc when said coin passing unit is in said closed position, a thickness setting cam extending horizontally and being rotatably mounted on said machine frame, and means for adjusting a vertical position of said lock pin relative to said machine frame in response to a rotated position of said thickness setting cam and thereby adjusting the thickness of the coin path.

2. An apparatus according to claim 1, wherein said adjusting means comprises a receiving plate attached to a lower end of said lock pin and a lever swingably mounted in a vertical direction at one end thereof on said machine frame and being engaged at its other end with said cam and being engaged at an intermediate portion with said receiving plate.

3. An apparatus according to claim 1, further comprising means included in said coin passing unit for locking said coin passing unit to said lock pin.

* * * * *